US005974750A

United States Patent [19]

Landin et al.

[11] Patent Number: 5,974,750

[45] Date of Patent: Nov. 2, 1999

[54] FIRE BARRIER PROTECTED DYNAMIC JOINT

[75] Inventors: Heather V. Landin, Baldwin; Paul J. Charland, New Richmond, both of Wis.; John D. Nicholas, Lawrenceville, Ga.

[73] Assignee: 3M Innovative Properties Company, St. Paul, Mich.

[21] Appl. No.: 09/014,029

[22] Filed: Jan. 27, 1998

Related U.S. Application Data

[63] Continuation of application No. 08/391,939, Feb. 21, 1995, Pat. No. 5,765,332.

[51] Int. Cl.[6] ..... E04B 1/24

[52] U.S. Cl. ..... 52/396.01; 52/573.1; 52/396.04

[58] Field of Search ..... 52/393, 394, 395, 52/396.02, 396.03, 396.04, 396.08

[56] References Cited

U.S. PATENT DOCUMENTS

| | | |
|---|---|---|
| Re. 24,906 | 12/1960 | Ulrich . |
| 3,916,057 | 10/1975 | Hatch et al. . |
| 4,273,879 | 6/1981 | Langer et al. . |
| 4,305,992 | 12/1981 | Langer et al. . |
| 4,364,210 | 12/1982 | Fleming et al. . |
| 4,433,732 | 2/1984 | Licht et al. . |

FOREIGN PATENT DOCUMENTS

| | | |
|---|---|---|
| 36 32 648 C1 | 9/1986 | Germany . |

*Primary Examiner*—Creighton Smith
*Attorney, Agent, or Firm*—David B. Patchett

[57] ABSTRACT

A fire barrier protected dynamic joint in a structure, and a method for installing the same. The fire barrier protected dynamic joint includes a flexible sheet of a fire barrier material and a adhesive material for bonding the sheet to an attachment area of the joint.

32 Claims, 10 Drawing Sheets

FIRE BARRIER PROTECTED DYNAMIC JOINT

This application is a continuation of Ser. No. 08/391,939 filed Feb. 21, 1995 now U.S. Pat. No. 5,765,332.

FIELD OF THE INVENTION

The present invention relates to a fire barrier protected dynamic joint in a structure, and a method for installing the same.

DESCRIPTION OF THE RELATED ART

Building codes for commercial structures generally require fire barriers capable of preventing flame and smoke from passing through building joints into adjoining areas. Further, such fire barriers are typically required to reduce or eliminate "chimney effect." The chimney effect refers to the tendency of air or smoke in a vertical passage to rise when heated, potentially spreading smoke throughout the structure. Various fire stop devices are commercially available for static joint and through-penetration applications. Such devices, which include fire retardant and/or intumescent putties, caulks, wraps, and mats, typically are capable of passing rigorous American Society of Testing Materials (ASTM) fire endurance tests (i.e., ASTM E814-83 and ASTM E119-88).

The above mentioned firestop products, however, are typically unsuitable for providing fire barrier protected dynamic joints in buildings. A fire barrier for a dynamic joint generally needs to retain its resiliency over an extended period of time under dynamic conditions. Further, during a fire condition, the joint is likely to be subject to even greater movement, thereby making it necessary that the fire barrier to retain its integrity and prevent the migration of flame and smoke under such conditions.

Dynamic joints are generally linear openings in a building designed to allow for building movement. Examples of dynamic joints include joints within floors or wall, and joints between floors and walls. Dynamic joints are often referred to in the trade as "construction joints," "soft joints," "expansion joints," and "seismic joints." A common type of construction joint, known as an "exterior wall gap," is present between exterior walls or curtain walls and the structural elements of a building.

One type of fire barrier device used for dynamic joints involves mechanical fastener that secure the device to the building. Mechanically fastened fire barrier devices, however, are labor intensive to install and add a considerable amount of material cost to a building. For example, it is frequently necessary to drill holes into a portion of the building to attach the mechanical fastening means. In another aspect, some mechanically fastened fire barriers are difficult to install due to space and configuration constraints.

Compression deflection is another means for installing fire barriers into a building or structure. In common embodiment, a resilient fire barrier material is compression-fit into a dynamic joint. Compression deflection fire barriers, which are installed at the nominal width of a joint, are designed to seal against a fire even when the joint is at its maximum width. For example, a 5.08 cm (2 inches) nominal joint may cycle between a minimum joint width of 2.54 cm (1 inch) and a maximum joint width of 7.62 cm (3 inches). Many building codes require joints to be fire tested at their maximum joint width. Therefore, a fire barrier tested for its maximum joint width of 7.62 cm (3 inches) usually requires 8.89 cm (3.5 inches) of material to be compressed into the joint for fire testing. While this is not a difficult task to accomplish under laboratory conditions, field installation tends to be more problematic. Installing a 8.89 cm (3.5 inches) thick material into a 5.08 cm (2 inches) nominal joint often results in the material being undesirably crushed or damaged by the severe methods used to compress the material into the joint.

ASTM E 1399-91 evaluates the cyclic movement and measures the minimum and maximum joint widths of joint systems including fire barriers. The compression deflection attributes of fire barriers are evaluated with ASTM E 1399-91 under the specified movement parameters of the manufacturer of the fire barrier. One cause of failure for fire barriers evaluated under this test is fatigue of the resilient fire barrier material after several cycles, which reduces the resistive force of the resilient fire barrier material to compression. In some circumstances, severe fatigue causes the material to fall out of the joint. Another potential problem of compression deflection fire barriers is that they are susceptible to compression set or creep due to the dynamic nature of the joint.

It is common practice in the fire barrier industry to use a number of fire resistant caulks to seal small voids in a fire barrier system or as sealants between a fire barrier and a structure. Such products, however, are not recommended as a structural adhesives capable of withstanding fire conditions.

For example, a fire caulk sold under the trade designation "FIBERMAX" by Carborundum of Niagara Falls, N.Y., is said by Carborundum to have continuous service limit of 1537.8° C. (2800° F.) . Similarly, a fire adhesive sold under the trade designation "SUPER CAL STIK" by Pabco of Houston, Texas, is said by Pabco to have a maximum continuous service temperature of 982° C. (1800° F.). After curing, however, this Pabco adhesive becomes brittle, perhaps due to the ceramic nature of the adhesive. The brittleness of the cured adhesive may make the bond susceptible to failure due to vibration or building movement.

A silicone sealant sold under the trade designation "DOW CORNING FIRESTOP SEALANT 2000" by Dow Corning Corporation of Midland, Mich., is said by Dow Corning to have continuous service temperature of 150° C. (302° F.). This Dow Corning product, like other silicone sealants, degrades rapidly under fire conditions, becoming brittle and ultimately under such conditions is reduced to a powder.

None of the specific products described above are recommended for structural bonding applications.

Further, sealants (commonly referred to as "smoke sealants) are used to directly bond with fibrous insulation products such as those available under the trade designations "FIBERFRAX" from Carborundum of Niagara Falls, N.Y.; "CERAWOOL," "CERABLANKET," and "KAOWOOL" from Thermal Ceramics of Augusta, Ga., in non-flexible fire stop applications (e.g., in penetration openings in fire rated walls). Although typically not intended to be used in dynamic joints, if such sealants are used with such fibrous insulation in the same manner as used in the non-flexible application, fiber fracturing, compression set, and cohesive failure occur during typical cycling of a dynamic joint and exposure to a fire condition.

SUMMARY OF THE INVENTION

The present invention provides a fire barrier system comprising:

a) a (dynamic) joint comprising a first structural element having a first surface and a first attachment area, and a second structural element having a second surface and a second attachment area, the elements being moveable with respect to one another, the first and second surfaces being juxtaposed to define a space therebetween, the space having a fixed length and a width which varies from a minimum width to a maximum width as the elements move with respect to each other; and b) a flexible sheet of fire barrier material having a first area attached by a first attachment means at or adjacent the first surface at the first attachment area of the first element, a second area attached by a second attachment means at or adjacent the second surface at the second attachment area of the second element, an unattached intermediate area between the first and the second areas, a width at least the length of the space and a length at least as long as the maximum width of the space, and an intermediate area mass; wherein at least one of the attachment means comprises an adhesive material applied between one of the attachment areas of the sheet and its corresponding attachment area of one of the elements in an amount and of a type which provides an adhesive material bond therebetween having at least one of a tensile or a shear bond strength which in force units is at least equal to ¼ of the product (preferably, at least equal to ½ of the product, more preferably, at least equal to ¾ of the product, and even more preferably, at least equal to the product) of the mass of the intermediate area times the acceleration due to gravity.

Preferably, the fire barrier system is capable of withstanding a fire test condition.

The attachment means present in the fire barrier system are sufficient to secure the flexible sheet of fire barrier material within the joint under ambient conditions and typical fire conditions for a desired period of time. The attachment means can further comprise conventional attachment means known in the art including mechanical attachment means (e.g., a bolt(s), a nail(s), a screw(s), friction, a clamp(s), a dowel(s), a pin(s), a weld(s), or a crimp(s)). Both the first and the second attachment means can include the adhesive material. Further, both the first and second attachment means can include conventional attachment means.

Tensile bond strength is determined by measuring the force substantially 180° from the attachment area of both the structural element and the flexible sheet (i.e., the angle of removal is 180°) to cause the adhesive bond to fail cohesively, adhesively, or a combination thereof, wherein the separation rate of the structural element and the flexible sheet is 2 cm/minute. Shear bond strength is determined by measuring the force substantially 90° (i.e., the angle of removal is 90°) from the attachment area of both the structural element and the flexible sheet to cause the adhesive bond to fail cohesively, adhesively, or a combination thereof, wherein the separation rate of the structural element and the flexible sheet is 2 cm/minute.

The flexible sheet of fire barrier material may extend along at least one attachment area of a dynamic joint to substantially conceal the adhesive material between the flexible sheet and the attachment area. The flexible sheet may be configured to extend between a plurality of attachment areas so that the adhesive material is substantially enclosed. Substantially enclosing the adhesive material between the attachment area and the flexible sheet of fire barrier material minimizes the profile of the adhesive material to a fire condition. The minimum profile of the adhesive material provides a region having a low oxygen environment around the majority of the adhesive material so as to slow its rate of disintegration or degradation during a fire condition. By knowing the rate of disintegration or degradation of a particular adhesive material and the configuration of the fire barrier system, it is possible to design a fire barrier system that can withstand a fire condition for a predetermined period of time.

The flexible sheet may also be configured to have a plurality of layers of fire barrier material joined together to define gaps therebetween. The gaps may be air voids, or may be filled with an insulating material.

The fire barrier material for a particular fire barrier system is selected and arranged with respect to the other components of the system to provide a barrier that prevents the passage of combustion products (e.g., flame, hot gases including smoke, and heat) from one area to another for at least 30 minutes (preferably, at least one hour; more preferably, at least two hours, and most preferably, at least four hours) during a fire condition.

Suitable flexible sheets of fire barrier material include intumescent mats, glass fiber bats, mineral fiber bats (also known as mineral wool bats), ceramic fiber fabrics, intumescent sheet materials, and endothermic sheet materials. Organic or inorganic binders may be present in the fibrous mats. At least one side of the flexible sheet can include a layer of metal foil. The metal foil can be oriented to face or engage with the fire condition. The adhesive material can be engaged with either the foil layer or the fibrous material. The flexible sheet can have resilient properties which permit the material to be pressure fit in the dynamic joint.

The adhesive material retains the flexible sheet of fire barrier material to an attachment surface of any orientation. In particular, the flexible sheet may be hung from a downward facing attachment area.

The adhesive material for a particular fire barrier system is selected and arranged with respect to the other components of the system to provide the desired or specified adhesive bond strength under ambient conditions and typical fire conditions for a desired period of time. For example, the adhesive material is preferably selected to provide the desired or specified adhesive bond strength at temperatures in the range from about −30° C. to about 50° C. for at least one month (preferably, at least one year, more preferably, at least five years, even more preferably, at least ten years, and most preferably, at least twenty years), and which at temperatures up to at least 260° C. (500° F.) (preferably, at least 427° C. (800° F., more preferably, at least 649° C. (1200° F.)) retains or transforms into material that provides the desired or specified adhesive bond strength for at least 10 minutes (preferably, at least 30 minutes, more preferably, at least one hour, even more preferably, at least two hours, and most preferably, at least four hours). Preferably, the adhesive material provides an adhesive bond strength greater than that desired or specified.

In one embodiment, a self-extinguishing adhesive material (e.g., silicone adhesive material) is used. When exposed to a fire condition in a low oxygen environment, such self-extinguishing adhesive materials retain their adhesive properties for an extended period of time.

In another embodiment, the adhesive material forms a hard char when exposed to a fire condition. When adhered to a fibrous sheet, a char-forming adhesive material creates a semi-oxidized carbon matrix with mechanical properties sufficient to support the fire barrier system. Acrylics, epoxies, and urethane, adhesives have some or all of these properties.

In yet another aspect, the present invention provides a method for attaching a fire barrier device to a dynamic joint in a structure, the method comprising the steps of:

(a) comprising a first structural element having a first surface and a first attachment area, and a second structural element having a second surface and a second attachment area, the elements being moveable with respect to one another, the first and second surfaces being juxtaposed to define a space therebetween, the space having a fixed length and a width which varies from a minimum width to a maximum width as the elements move with respect to each other;

(b) providing a flexible sheet of fire barrier material having a first area for attachment at or adjacent the first surface at the first attachment area of the first element, a second area for attachment at or adjacent the second surface at the second attachment area of the second element, an unattached intermediate area between the first and the second areas of the sheet;

(c) attaching the first area of the sheet by a first attachment means at or adjacent the first surface at the first attachment area of the first element and the second area of the sheet by a second attachment means at or adjacent the second surface at the second attachment area of the second element, wherein at least one of the attachment means comprises an adhesive material applied between one of the areas of the sheet and its corresponding attachment area of one of the elements in an amount and of a type which provides an adhesive material bond therebetween having at least one of a tensile or a shear bond strength which in force units is at least equal to ¼ of the product of the mass of the intermediate area times the acceleration due to gravity.

The method can include configuring the flexible sheet of fire barrier material to extend along at least one attachment area to substantially conceal the adhesive material between the flexible sheet and the attachment area. By determining the rate of disintegration or degradation of the adhesive material along the attachment area, it is possible to configure the present fire barrier system to withstand a fire condition for a predetermined period of time.

Further, the method can include configuring the flexible sheet into a plurality of layers defining gaps therebetween. The gaps may be air voids or can contain an insulating material.

In this application:

"char-forming" refers to the ability of an adhesive material to create a hard char when the adhesive material is exposed to flame or heat, typically at temperatures above 200° C., wherein the hard char assists in supporting the fire barrier system during a fire condition or fire test condition;

"fire test condition" means the fire test described in ASTM E119-88, the disclosure of which is incorporated herein by reference, wherein the fire barrier system is capable of passing the ASTM test for a period of at least 30 minutes (preferably, at least one hour, more preferably, at least two hours, and most preferably, at least four hours);

"1.0 g" refers to the acceleration due to gravity at the earth's surface;

"ceramic" refers to crystalline ceramics, glass, and glass-ceramics;

"mullion" means any structural frame system for retaining an external shell to a building structure; and "self extinguishing" refers to the inability of a material to sustain combustion without the addition of an external fuel source.

DETAILED DESCRIPTION OF THE PREFERRED EMBODIMENTS

It should be understood that the present invention is not limited to specific types of dynamic joints or to particular configurations of a flexible sheet of fire barrier material. Further, it has been found that when the present invention is correctly practiced, any of a variety of adhesive materials are capable of supporting the fire barrier system during a fire condition.

Figure 1:
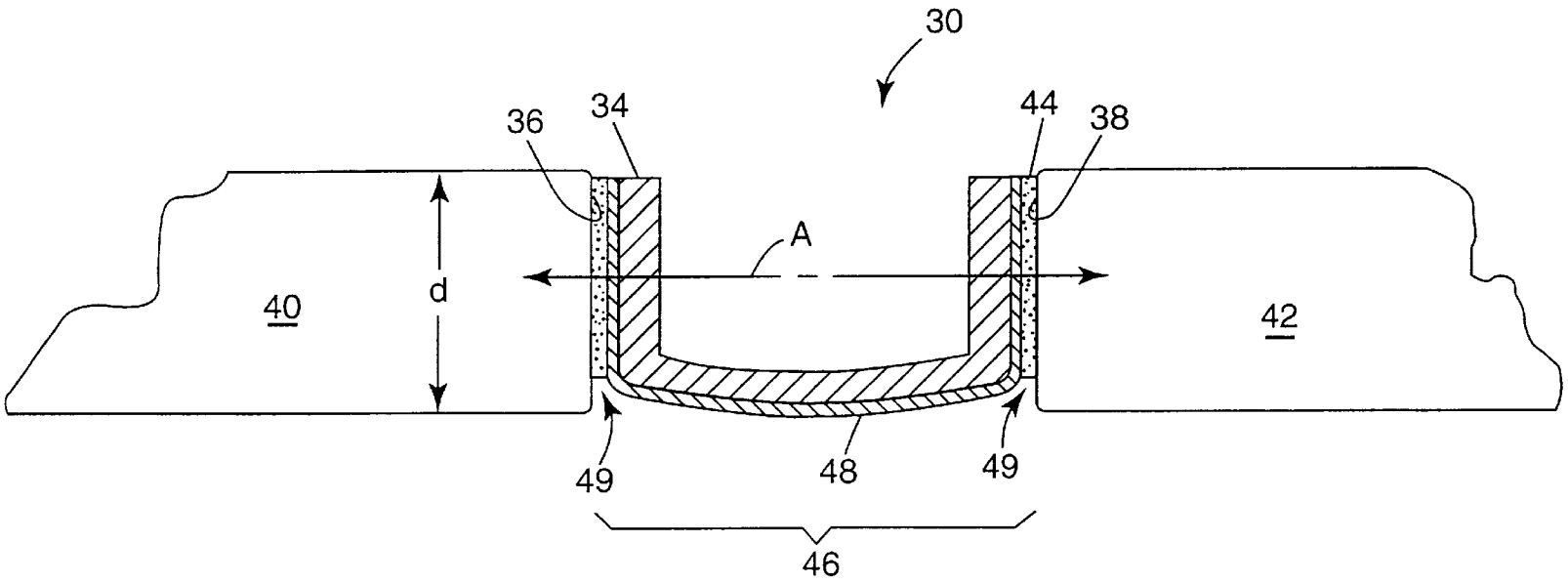
FIG. 1 is a sectional view of a fire barrier protected dynamic joint in accordance with the present the present invention.

FIG. 1 is a sectional view illustrating an exemplary configuration of fire barrier device 30 in a dynamic joint. Flexible sheet of fire barrier material 34 is configured to engage with end faces or attachment areas 36 and 38 of building sections 40 and 42. Flexible sheet 34 has outer shell 48 to enhance adhesion with adhesive material 44. Outer shell 48 can be constructed, for example, from a ceramic cloth or metal foil. Adhesive material 44 is interposed between outer shell 48 and end faces or attachment areas 36 and 38 for retaining fire barrier device 30 in the dynamic joint. The weight of sheet 34 has caused middle region 46 to sag, providing slack for outward expansion of the joint along axis "A".

Sheet 34 is configured to minimize profile 49 of adhesive material 44 to a fire condition. In one embodiment, the low oxygen environment in combination with a low exothermic adhesive material (e.g., silicone adhesive) has been found to reduce the rate at which adhesive material 44 disintegrates during a fire condition. In one exemplary embodiment, the adhesive material is ablated at a rate of 1 inch (2.54 cm) per hour under a fire test condition. Therefore, for that exemplary embodiment, for the fire barrier system shown in FIG. 1 to survive a 4-hour fire test, distance "d" must be greater than 10.16 cm (4 inches). In an alternate embodiment, epoxy adhesives degrades into a hard-char when exposed to a fire condition in a low oxygen environment. The resulting hard-char has sufficient structural integrity to support fire barrier device 30.

Figure 2:
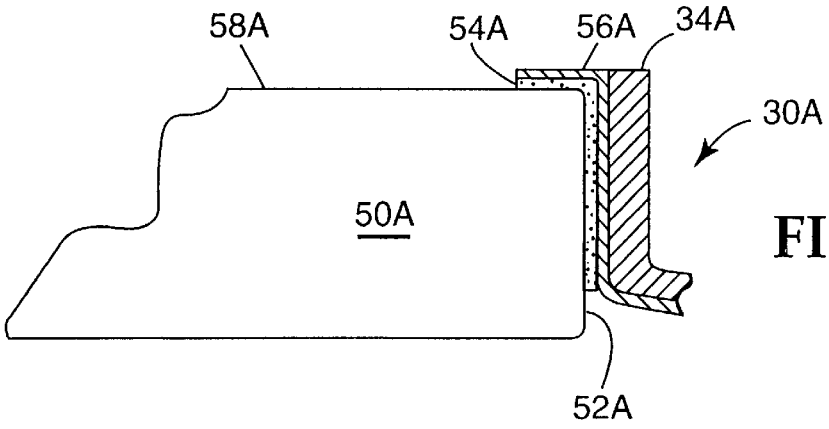
FIGS. 2–4 are sectional views of alternative embodiments of the invention illustrating various options for a fire barrier to a structure.
Figure 3:
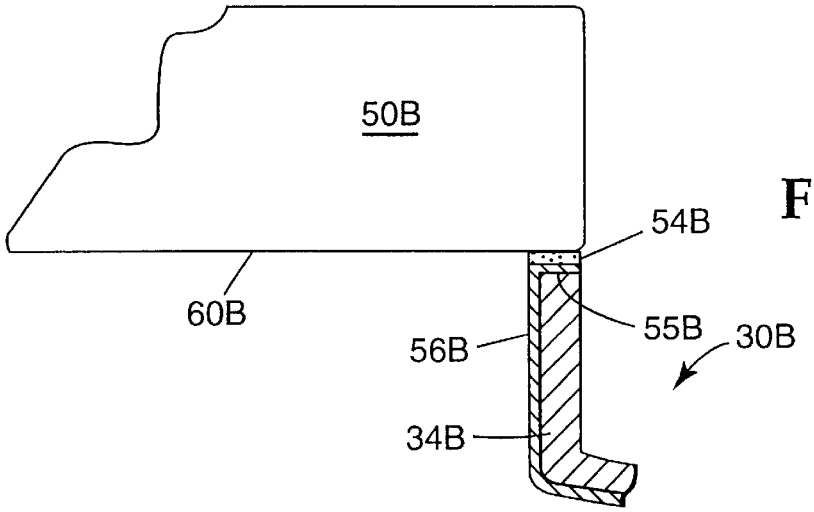
Figure 4:
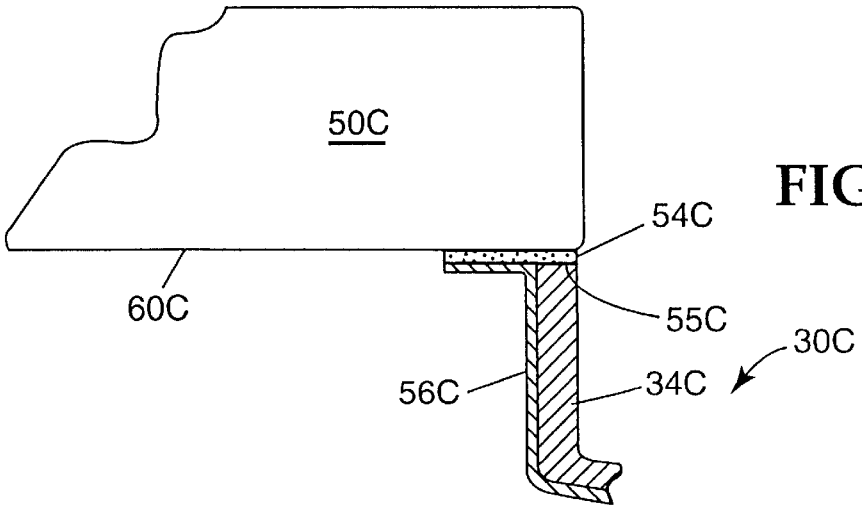

FIGS. 2 through 4 illustrate various methods for attaching fire barrier device 30A to building section 50A. In FIG. 2, flexible sheet of fire barrier material 34A is adhered to generally vertical end face 52A on building section 50A by adhesive material 54A. Outer shell 56A on flexible sheet 34A extends away from fire barrier device 30A onto wear surface 58A to provide additional surface area for bonding. Outer shell 56A provides a low profile attachment which does not interfere with wear surface 58A.

FIG. 3 illustrates an alternate configuration for attaching fire barrier device 30B to bottom surface 60B of building section 50B. Outer shell 56B extends around end face 55B of flexible sheet of fire barrier material 34B. Adhesive material 54B is interposed between outer shell 56B and bottom surface 60B to suspend fire barrier device 30B from horizontal surface 60B.

FIG. 4 illustrates an alternate method for suspending fire barrier device 30C from bottom surface 60C of building section 50C. Adhesive material 54C is interposed between end face 55C of flexible sheet of fire barrier material 34C. Outer shell 56C of flexible sheet 34C extends away from fire barrier device 30C and is attached to lower surface 60C with adhesive material 54C to provide additional support.

Figure 5:
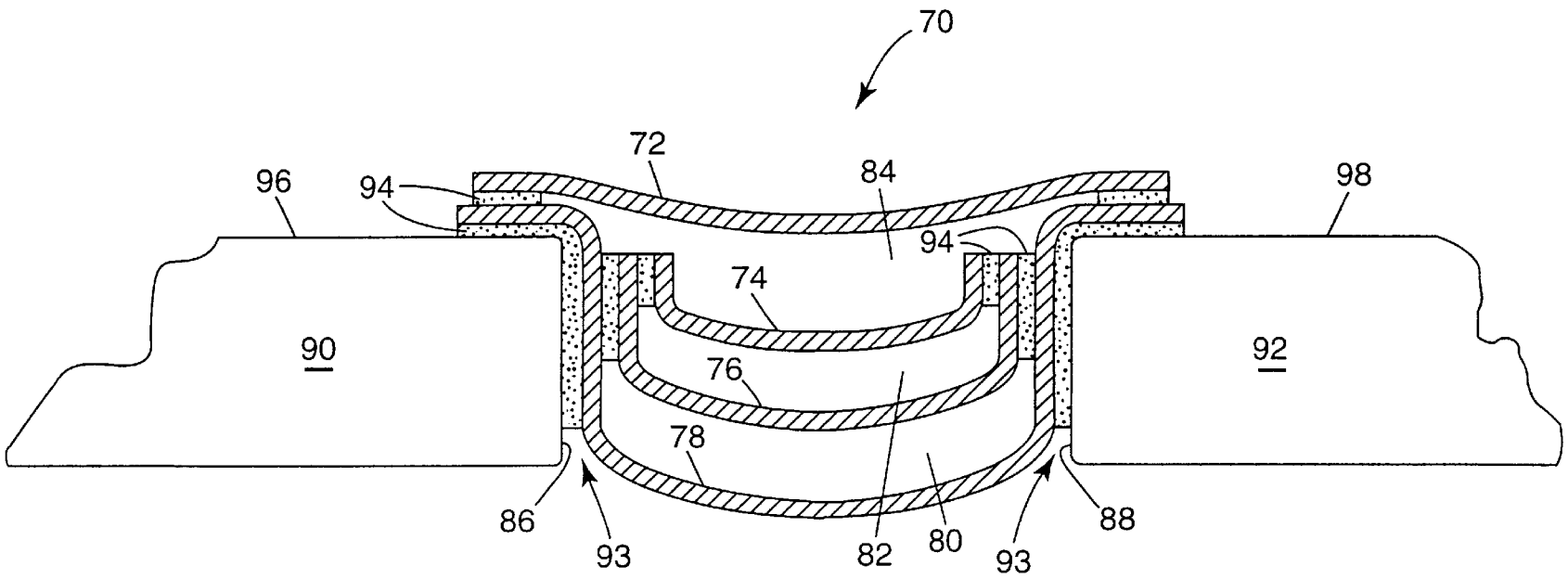
FIGS. 5–8 are sectional views which illustrate alternate embodiments to the present invention.

Referring to FIG. 5, fire barrier device 70 comprises plurality of flexible fire barrier members 72, 74, 76, and 78 layered to create gaps 80, 82, and 84 therebetween. One method for installing fire barrier device 70 is to attach flexible fire barrier member 78 to end faces or attachment areas 86 and 88 of building sections 90 and 92 with adhesive material 94. Flexible fire barrier member 76 is then attached to member 78 by adhesive material 94 or other suitable method. Member 74 is likewise attached to member 76. Further, flexible fire barrier member 72 may be attached to the portions of member 78 which extend along top surfaces 96 and 98 of building sections 90 and 92.

Fire barrier device 70 may be assembled prior to installation. Further, flexible fire barrier members 72–78 may be joined together by any of a variety of methods including, for example, metal fasteners, clips, or the like. As discussed in connection with FIG. 1 above, fire barrier material 78 is configured to minimize exposure 93 of adhesive material 94 to a fire condition. The adhesive joints between members 76 and 78, 74 and 76, and 72 and 74 in FIG. 5 are likewise configured.

Figure 6:
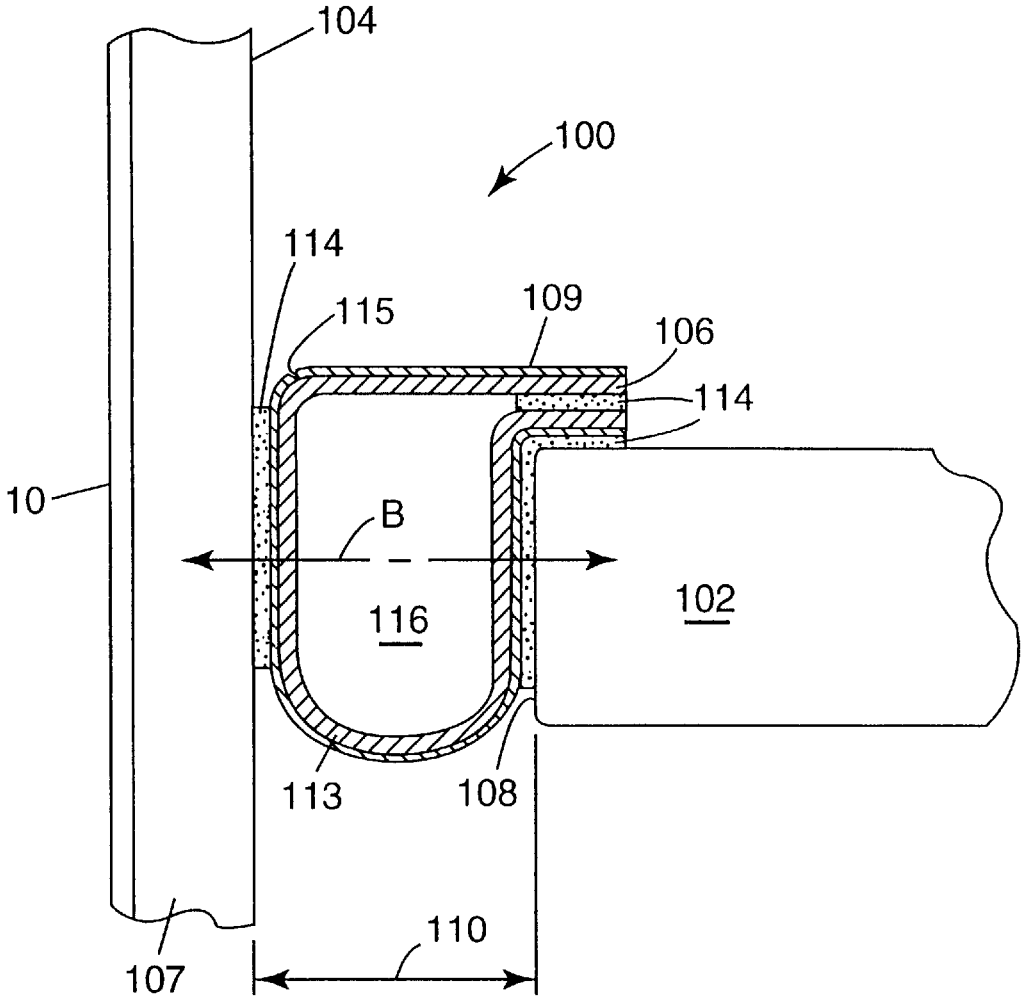

FIG. 6 is a side sectional view illustrating fire barrier device 100 for use between building section 102 and a portion of curtain wall member 104. External covering 10 and insulation 107 are supported and attached to the building structure by a mullion (not shown). Flexible sheet of fire barrier material 106 includes metal foil 109 laminated thereto is configured to extend generally along end face or attachment area 108 of building section 102, across gap 110 in a dynamic joint, and along portion of curtain wall member 104. Metal foil 109 may include slit 115 to interrupt the heat flow along fire barrier device 100. Adhesive material 114 is applied to end face or attachment area 108 and foil face of curtain wall 104 for retaining flexible sheet 106 to those members. Excess slack 113 in flexible sheet 106 allows for expansion of the joint along axis "B". The flexible sheet may also extend from curtain wall member 104 back to building section 102 to completely enclose fire barrier device 100. Center portion 116 of fire barrier device 100 may be left empty or can be filled with a suitable fire-resistant material.

Figure 7:
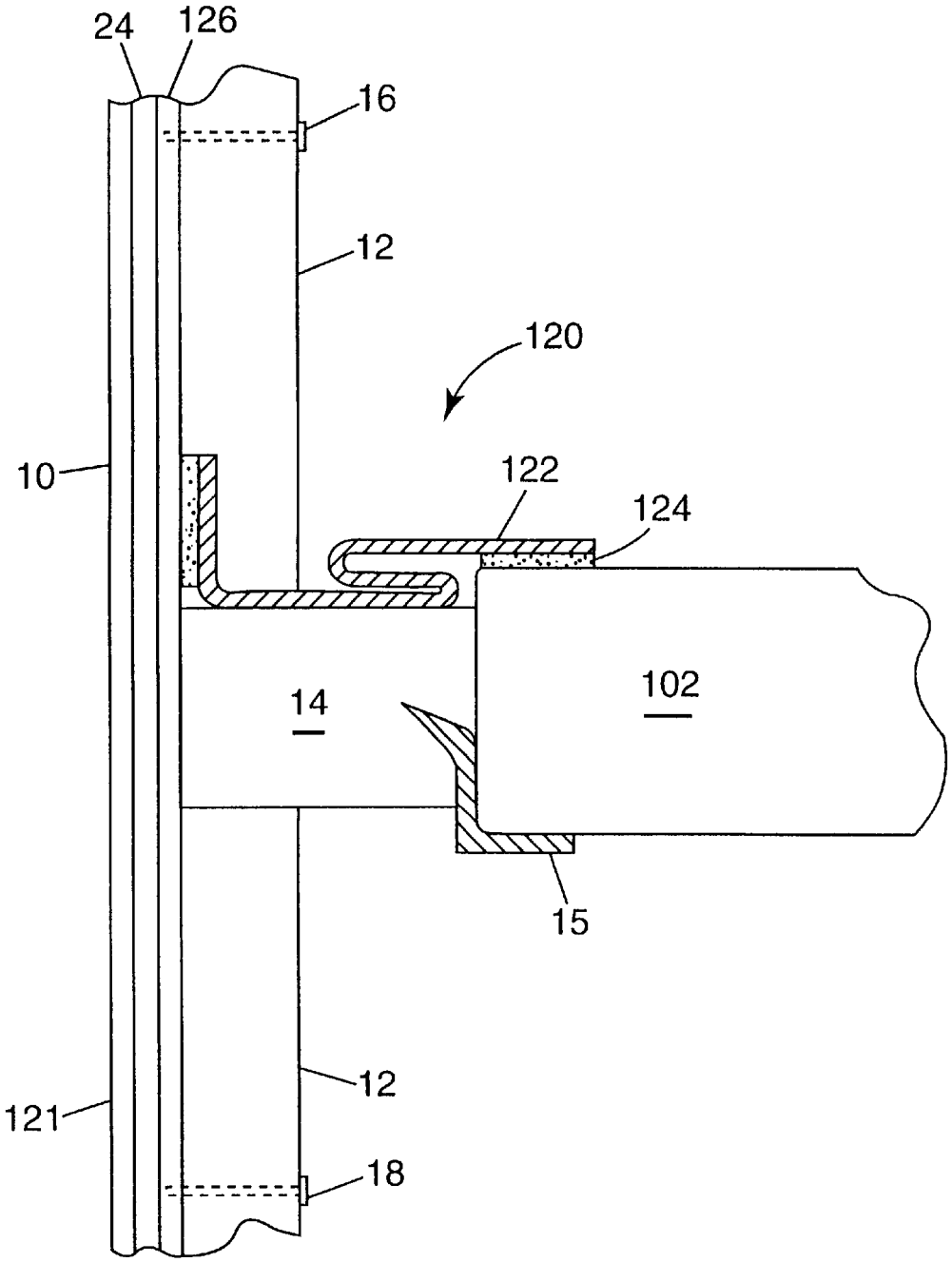

Referring to FIG. 7, fire barrier device 120 is shown in a typical curtain wall installation. Curtain wall 121 includes an external covering 10 and back pan 126 supported by a mullion (not shown). The mullion maintains air gap 24 between external covering 10 and back pan 126. Insulation 12 is typically attached to inside surface of back pan 126.

Flexible sheet of fire barrier material 122 is configured to allow significant expansion between building section 102 and curtain wall 121. One edge of flexible sheet 122 is attached to building section 102 by adhesive material 124. Flexible sheet 122 is folded so that excess material is supported on insulating material 14 within a dynamic joint. Flexible sheet 122 is then attached to back pan 126 using adhesive material 124. In the event that insulating material 14 disintegrates or z-clip 15 fails during a fire condition, and insulation 14 falls out of the dynamic joint, adhesive material 124 retains sheet 122 in the dynamic joint. The configuration in FIG. 7 is particularly suited, for example, for retrofitting existing structures that have mechanically secured fire barriers, such as fire barriers of mineral wool employing z-clip 15.

Figure 8:
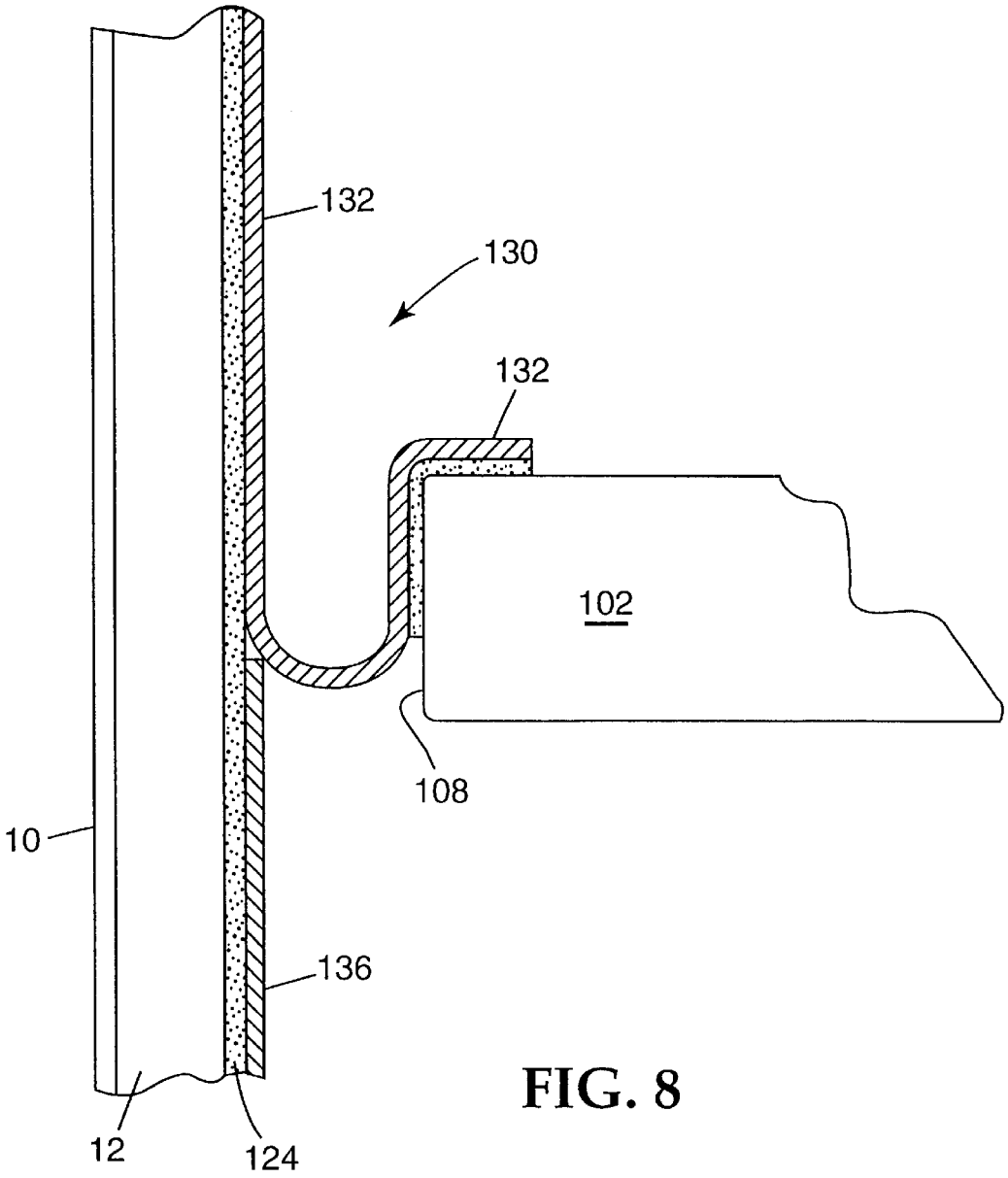

FIG. 8 is a sectional view of an exemplary embodiment of a curtain wall and joint fire barrier system. Fire barrier device 130 includes flexible sheet of fire barrier material 132 in a trough configuration. The trough may be filled with or covered with suitable insulating material to achieve a desired fire rating. Flexible sheet 132 is attached to insulation 12 and end face or attachment area 108 by adhesive material 124. Additional section of flexible sheet 136 may be attached to insulation 12 below the dynamic joint.

In broad terms, the present fire barrier system relates to attaching a flexible sheet of fire barrier material to dynamic joints using an adhesive material for the projected lifetime of the building. Preferred embodiments according to the present invention provide an effective barrier to flame, smoke, and heat, and meet the requirements as set forth in ASTM E119-88, "Fire Tests of Building Construction and Materials".

One embodiment of a flexible sheet of fire barrier material includes at least one insulating layer and at least one layer of a heat resistant material. The heat resistant layer can be constructed, for example, of a metal foil, a graphite foil, or a ceramic fabric layer. A heat resistant layer strengthens the fire barrier material and provides additional structural strength for attachment of the heat resistant layer in a joint. A heat resistant layer may also have enhanced adhesion characteristics with a particular adhesive material. Metal or graphite foil layers additionally serve to reflect or conduct heat away from the heat resistant layer during a fire. A number of suitable heat resistant layers are commercially available, including ceramic cloth materials (e.g., a woven fabric of vitreous silicate fibers is commercially available under the trade designation "ZETEX" from Newtex of Victor of New York, N.Y.; a flexible, high silica yarn mat composed of spun-woven roving and double shredded yarn is commercially available under the trade designation "SILTEMP" from Ametek of Wilmington, Del.; an amorphous silica textile is commercially available, for example, under the trade designation "SANDTEX" from Cooperheat of Benicia, Calif.; and an aluminoborosilicate fabric is commercially available, for example, under the trade designation "NEXTEL 312 CERAMIC FABRIC" from the 3M Company of St. Paul, Minn.). It is understood that the outer shell may be constructed of any suitable heat-resistant material and that the present invention is not limited to ceramic cloth.

The insulating layer can be constructed from a high-temperature resistant material such as ceramic fiber mats or fabrics (e.g., glass fiber mats and nonwoven ceramic fiber mats), mineral fiber (also known as mineral wool) mats, and intumescent and endothermic sheet materials. Organic or inorganic binder may be present in the fibrous bats. Useful glass fibers including chopped glass fibers (e.g., magnesium aluminosilicate glass fibers) are commercially available, for example, under the trade designation "S2-GLASS" from Owens-Corning Fiberglass Corp. of Granville, Ohio. Suitable glass fiber mats (e.g., silica fiber mats) are commercially available, for example, under the trade designation "FIBERGLASS" from Owens-Corning Fiberglass Corp.

Other ceramic fibrous materials suitable for use in an insulating layer of the present flexible fire barrier material include ceramic oxide fibers (such as small diameter melt-blown aluminosilicate ceramic fibers commercially available, for example, under the trade designations "FIBERFRAX DURABACK BLANKET" from Carborundum Co. of Niagara Falls, N.Y. and aluminosilicate fibers commercially available, for example, under the trade designations "CERAWOOL" and "KAOWOOLII from Thermal Ceramics of Augusta, Ga.; and ceramic oxide fibers commercially available, for example, from the 3M Company under the trade designation "NEXTEL" (e.g., aluminosilicate ceramic oxide fibers commercially available under the trade designation "NEXTEL 440??, aluminoborosilicate ceramic oxide fibers commercially available under the trade designation "NEXTEL 312", and alumina ceramic oxide fibers commercially available under the trade designation "NEXTEL 610")). Useful mineral wool mats (such as, mineral wool derived from blast furnace slag having the major components silica, calcia, alumina, and magnesia) include those available, for example, under the trade designation "THERMOFIBER" from U.S. Gypsum of Chicago, Ill.

The insulating layer can be constructed from intumescent materials or from endothermic materials. Endothermic materials absorb heat and are used to shield construction components from the effects of high temperatures. Useful endothermic mat materials are available, for example, under the trade designation "INTERAM MAT E-5" from the 3M Company. These high temperature resistant materials are generally sufficiently flexible to conform to complex shapes and to conform to dimensional changes due to movement in a dynamic joint.

The preferred thermal insulating layer is an intumescent sheet material that expands into a low density insulation blanket when exposed to a temperature above about 200° C. Intumescent sheet material useful for the practice of the present invention include polymeric binders, fillers, and intumescent particles. Useful intumescent particles include silicates, expanding graphite, and vermiculite. Typically, these particles are compounded with sufficient additives to make a sheet that has suitable expansion, flexibility, and handling characteristics and that can be fit into a confined space. When subjected to heat or flames, the intumescent sheet material expands and serves as a barrier to heat, smoke, and flames.

Useful intumescent materials are available, for example, under the trade designation "FIRE BARRIER I-10C" from the 3M Company. This 3M Company product is a 0.63 cm thick intumescent mat having a 0.051 mm (2 mil) thick steel foil laminated thereto. Another useful intumescent mat material is available, for example, under the trade designation "INTERAM I-10A" from the 3M Company. This 3M Company product is a 0.5 cm thick intumescent mat having a 0.076 mm (3 mil) thick aluminum foil laminated thereto.

Adhesive materials useful in the practice of this invention include those that allow adhesion, for example, of metal foil, intumescent sheet, fiberglass bat, ceramic oxide fabric to a variety of surfaces, including concrete, metal (e.g., aluminum or steel), window glass and quartz viewpanes. Adhesive materials suitable for the practice of the present invention include epoxies, silicones, acrylics, and urethane. Silicones are preferred because they are relatively easy to apply and do not give off noxious gases upon heating. For example, urethane emits cyanide gas when exposed to a fire condition. In another aspect, silicones do not significantly soften and flow during a fire condition. Finally, silicones are endothermic adhesives and do not burn. Alternatively, epoxies are high exothermic adhesives that form a hard char when exposed to a fire condition. The resulting hard char forms a strong bond with the flexible fire barrier and substrate.

Adhesive materials typically are not stable (i.e., they decompose and/or soften) at temperatures encountered in a fire condition. A preferred adhesive for the practice of this invention is a silicone adhesive comprised of methyltrimethoxysilane, carbon black, calcium carbonate treated with stearic acid, and polysiloxane, commercially available under the trade designation "3M FIRE BARRIER SEAL AND BOND SILICONE" from the 3M Company. This adhesive was generally considered unstable at temperatures above 232° C. (450° F.), but was found to be stable up to about 414° C. (1000° F.) in the Illustrative Example described below. It is believed that this stability at such temperatures is due to the lack of oxygen at the adhesive surface. When joint systems designed for these materials are tested under fire conditions, the adhesive degrades inward from the exposed hot edges and the adhesive bond eventually fails. The rate of degradation and corresponding loss of bonding function is believed to be caused by contact with oxygen at the exposed edge. As will be discussed in the examples below, joints fastened with the above silicone adhesive passed the tests for movement in dynamic joints as described in ASTM E1399-91, the disclosure of which is incorporated herein by reference. An alternate adhesive is an epoxy available from Dow Chemical Corporation under the part number DER 331 or Sika Corporation of Sante Fe, Calif. under the trade designation "SIKADUR 31 HI MOD GEL."

The adhesive material is applied at a thickness sufficient to adhere the flexible sheet of fire barrier material to a construction material such as concrete or structural steel. The thickness typically ranges from about 0.08 cm to about 0.16 cm. A thick layer of adhesive material (0.5 cm) may be desirable for some applications, for example so that the adhesive material penetrates into the fiber matrix of a fibrous fire barrier material. Preferably, the adhesive material forms a layer with sufficient tack to produce adhesion between two materials within about 20 minutes of application. The time required for the tack to develop may vary due to humidity and/or ambient temperature.

The adhesive material can be applied anywhere on the insulating layer or the heat resistant layer. Typically, it is preferred to apply the adhesive to that side of the flexible fire barrier material which is structurally stronger, such as the side of the mat laminated to a metal foil.

Objects and advantages of this invention are further illustrated by the following examples, but the particular materials and amounts thereof recited in these examples, as well as other conditions and details, should not be construed to unduly limit this invention.

EXAMPLES

Fire Testing

For fire testing, an appropriate curtain wall or dynamic joint assembly was built to simulate that used in a building. The assembly was subjected to the temperature and time conditions of the fire test described in ASTM (American Society for Testing Materials) E119-88, entitled "Standard Test Methods for Fire Tests of Building Construction and Materials", incorporated herein by reference. The time and temperature parameters outlined in FIG. 1 published in E119-88 were followed for the test. The test was used to evaluate the duration for which a fire barrier system contained a fire or retain its structural integrity. The test exposed a specimen to a standard fire exposure controlled to achieve specified temperatures (i.e., the average temperature of the cold side of the fire barrier reaching 121° C. (250° F.) above the ambient temperature, or a single point temperature of 162.8° C. (325° F.) above the ambient temperature) throughout a specified time period. Typically the test results are referred to as a "3 hour" test, "2 hour" test, and so on. In some cases, the fire exposure test was followed by the hose stream test, wherein the apparatus was subjected to a high pressure water spray (described in ASTM E119-88, the disclosure of which is incorporated herein by reference).

Example 1

Example 1 illustrates the performance of fire barrier device 260 (see FIG. 10) in a simulated dynamic joint. A construction joint was formed that simulated a 2 hour fire rated floor, according to ASTM E119-88. To form this (expansion) joint, two concrete slabs (198 cm (78 inches) long×73.7 cm (29 inches) wide×11.4 cm (4.5 inches) deep) 280 and 282 were poured and cured. Slabs 280 and 282 were positioned on top of a 2.72 cubic meter (96 cubic foot) floor furnace built to ASTM E119-88 specifications. The joint formed between slabs 280 and 282 was 30.5 cm (12 inches) wide and 198 cm (78 inches) long.

Figure 10:
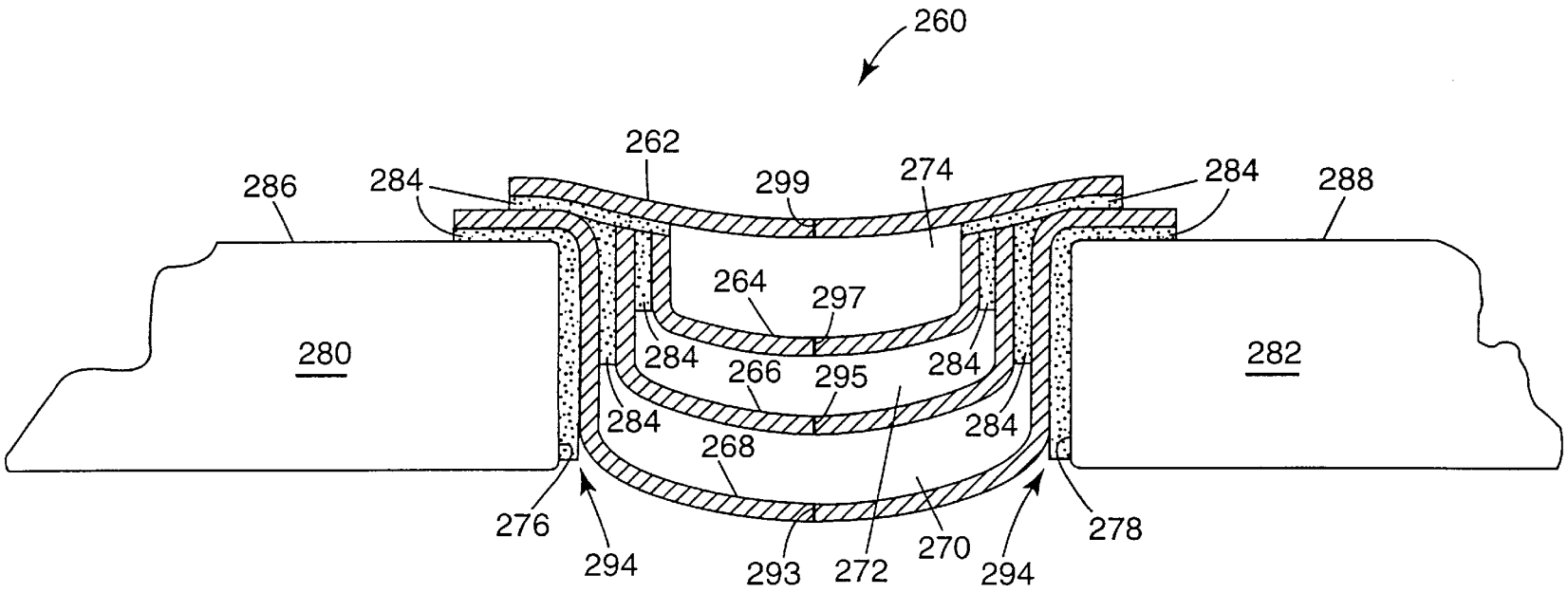
FIGS. 10–11 are sectional views which illustrate alternate embodiments to the present invention.

Four intumescent mats 262, 264, 266, and 268 were attached to slabs 280 and 282 with silicone adhesive material (commercially available under the trade designation "3M FIRE BARRIER SEAL AND BOND SILICONE" from the 3M Company) 284 as shown in FIG. 10. Mat 268 was a steel foil faced, flexible intumescent mat (commercially available under the trade designation "FIRE BARRIER I-10C MAT" from the 3M Company). Mats 262, 264 and 266 were aluminum foil faced, flexible intumescent mats (commercially available under the trade designation "INTERAM I-10A" from the 3M Company). All four mats were 198 cm (78 inches) long, the same length as the simulated floor joint. Mat 268 was 78.8 cm(31 inches) wide. Mats 262, 264, and 266 were 55.9 cm (22 inches), 45.7 (18 inches), and 45.7 cm (18 inches) wide, respectively.

Each of mats 262, 264, 266, and 268 were cut across their respective widths at the center and spliced back together as follows. The two mat sections were laid flat with the foil side up and butted together where they had just been cut.

Silicone adhesive ("3M FIRE BARRIER SEAL AND BOND SILICONE") was spread along the cut 5.1 cm (2 inch) to each side at a thickness of 0.08 cm (1/32 inch) to 0.16 cm (1/16 inch). A 10.2 cm (4 inch ) wide strip of 0.051 mm (2 mil) thick steel foil was pressed over the adhesive the full length of the cut. The splices were allowed to cure overnight.

Silicone adhesive ("FIRE BARRIER BOND AND SEAL SILICONE") was spread to cover the concrete slab end faces 276 and 278 and 10.2 cm (4 inches) over the adjacent edge of top faces 286 and 288 at a thickness of 0.08 cm (1/32 inch) to 0.16 cm (1/16 inch). The adhesive was allowed to cure for 15–20 minutes until sufficient tack had developed to allow the mat to adhere without supplemental support. Then, mat 268 was pressed, foil face to the adhesive, along the 10.2 cm (4 inch) wide strip of adhesive 284 on the top face 286, folded over the edge and pressed against the adjacent end face 276, 35.6 cm (14 inches) of mat draped across the 30.5 cm (12 inch) the space between the slabs at the bottom of the joint, pressed against the adhesive covered the other end face 278, and finally folded over and pressed to the 10.2 cm (4 inch) wide strip of adhesive on the edge of the top face 288.

Silicone adhesive ("FIRE BARRIER BOND AND SEAL SILICONE") 284 was spread on the non-foil side (face) of mat 268, 10.2 cm (4 inches) down from the top of each edge at a thickness of 0.08 cm (1/32 inch)to 0.16 cm (1/16 inch), and allowed to cure 15–20 minutes. The first 10.2 cm (4 inches) of the non-foil side (face) of the 55.9 cm (22 inch) mat 266 was pressed against one strip of silicone adhesive 284, 35.6 cm (14 inches) of mat were draped across the joint and the last 10.2 cm (4 inches) of the non-foil side (face) of the mat was pressed against the other strip of silicone adhesive 284. The edges of mat 266 were even with the top faces 286 and 288 of the slabs.

Next, mat 264 was adhesively fastened with only 5.1 cm (2 inches) at each edge of its non-foil side (face) adhered to the top edge of the foil face of mat 266.

Silicone adhesive ("FIRE BARRIER BOND AND SEAL SILICONE") 284 was applied in a 5.1 cm (2 inch) wide strip to the non-foil side (face) of mat 268 from the edge of faces 286 and 288 at a thickness of 0.08 cm (1/32 inch) to 0.16 cm (1/16 inch) and continued in a cohesive layer across the ends of mats 264 and 266 on both sides of the joint at a thickness of 0.08 cm (1/32 inch) to 0.64 cm (1/4 inch). The adhesive was allowed to cure for 15–20 minutes until sufficient tack had developed. Then, mat 262 was placed with 5.1 cm (2 inches) on each edge of the non-foil side (face) laid over the silicone adhesive 284 on each edge of mat 268 and 35.6 cm (14 inches) draped across the joint area. Mat 262 was then pressed into the silicone adhesive to secure it into place. The fire barrier assembly 260 had gap 270 about 3.8–5.1 cm (1.5–2 inches) between mats 268 and 266, gap 272 about 1.3–2.6 cm (0.5–1 inch) between mats 266 and 264, and gap 274 about 1.3–2.6 cm (0.5–1 inch) between mats 264 and 262.

The whole assembly was allowed to cure for 48 hours before fire testing. In preparation for testing the open ends of the fire barrier were blocked off with wads of high temperature ceramic fiber (commercially available under the trade designation "FIBERFRAX" from Carborundum of Niagara Falls, N.Y.), as were any gaps between the assembly and the furnace enclosure.

The fire test was run on the joint assembly for 3 hours according to the time-temperature curve of ASTM E119-88. Thermocouples were placed on the cold side of the assembly. The system received a 2 hour rating based on the temperature recorded on the cold side (ASTM E119-88 specifications). A 3 hour rating was almost received, but the highest thermocouple reading reached 203° F.) 398° F. by 3 hours, which was above the 200° C. (392° F.) limit for this test. Further, the average barrier temperature was above the 158° C. (316° F.) limit for this test. The ambient temperature prior to the test on the center of the cold side of the fire barrier was 20° C. (68° F.).

After 3 hours of test time, the assembly was removed from the furnace (i.e., the furnace was hot when the assembly was removed). The assembly was still intact and functioning as fire barrier. The joint was inspected and the condition of the adhesive noted. In the most heat stressed bond region (i.e., the area between the cement slab face and the surface of the mat closest to the fire) 294, the adhesive had disintegrated (i.e., decomposed to form a white powder) between the furnace-exposed edge of the bond and a line about 7.6 cm (3 inches) into the bond from that edge. This disintegration corresponds to approximately 2.54 cm (1.0 inch) per hour. There was about 2.5 cm (1.0 inch) width of adhesive remaining at the top, sufficient to hold the barrier into the joint under the fire test condition. The other bonded attachment points showed some degradation of the adhesive but were similarly intact. The bond at splice 293 on mat 268 nearest the fire was completely disintegrated. The bond at splice 295 on mat 166 was also disintegrated because ,it is believed, the aluminum foil laminated to the mat did not survive the temperatures encountered in the fire condition. The bond at splice 297 on mat 164 displayed disintegration of adhesive in from all the exposed edges but was sufficient to hold the mat together. The bond at splice 299 on mat 162 appeared to be unchanged. It is understood that the amount and kind of insulation in the fire barrier determines the temperature rating of the fire barrier so long as the fire barrier remains in place.

Example 2

Example 2 illustrates the performance of a fire barrier device in a simulated floor-to-floor condition using an epoxy adhesive. The fire condition was provided by a 0.19 $m^3$ (7 $ft^3$) gas fired furnace (commercially available as a kiln from Olympic Kilns of Atlanta, Ga.). The furnace had a circular 81.3 cm (32 inches) diameter opening at the top. Two concrete slabs (45.72 cm×96.52 cm×11.4 cm) designed for a two hour fire-resistance rating were fabricated. They were positioned on the furnace over the circular opening such that a 15.2 cm gap was formed between the two slabs. A thin coat, approximately 0.0125 cm thick, of epoxy adhesive epoxy (available under the trade designation "SIKADUR 31 HI MOD GEL" from Sika Corporation of Sante Fe, Calif.) was applied to the vertical concrete joint faces forming the gap.

A ceramic cloth material (sold under the trade designation "FIBERSIL" by Carborundum of Niagara Falls, N.Y.) was pressed into the epoxy forming a "U" shape. A layer of intumescent mat ("INTERAM I-10A") was nested atop of the ceramic cloth with the foil facing upward covering the ceramic cloth. A 2.5 cm thick layer of aluminosilicate ceramic fiber blanket (available under the trade designation "FIBERFRAX DURABACK BLANKET" from Carborundum Co. of Niagara Falls, N.Y.) was then placed atop the intumescent material covering it. A 0.63 cm aluminum plate was affixed over the fire barrier system. The epoxy cured for approximately 16 hours before testing.

The above construction successfully completed a 3 hour fire-endurance period according to the ASTM E 119 time-temperature curve. The sample was examined after the fire test. The epoxy adhesive had degraded into a hard char, but was still bonded to the ceramic cloth and concrete even at the point closest to the fire. There were no effects of bond loss due to the fire load or dead load of the joint system or disintegration of the adhesive at the bond line except for charring. The average ambient temperature of the cold side of the fire barrier before the test started was 23° C. (74° F.). The assembly received a 3 hour rating. The highest thermocouple reading was 162° C. (323° F.).

Example 3

Figure 11:
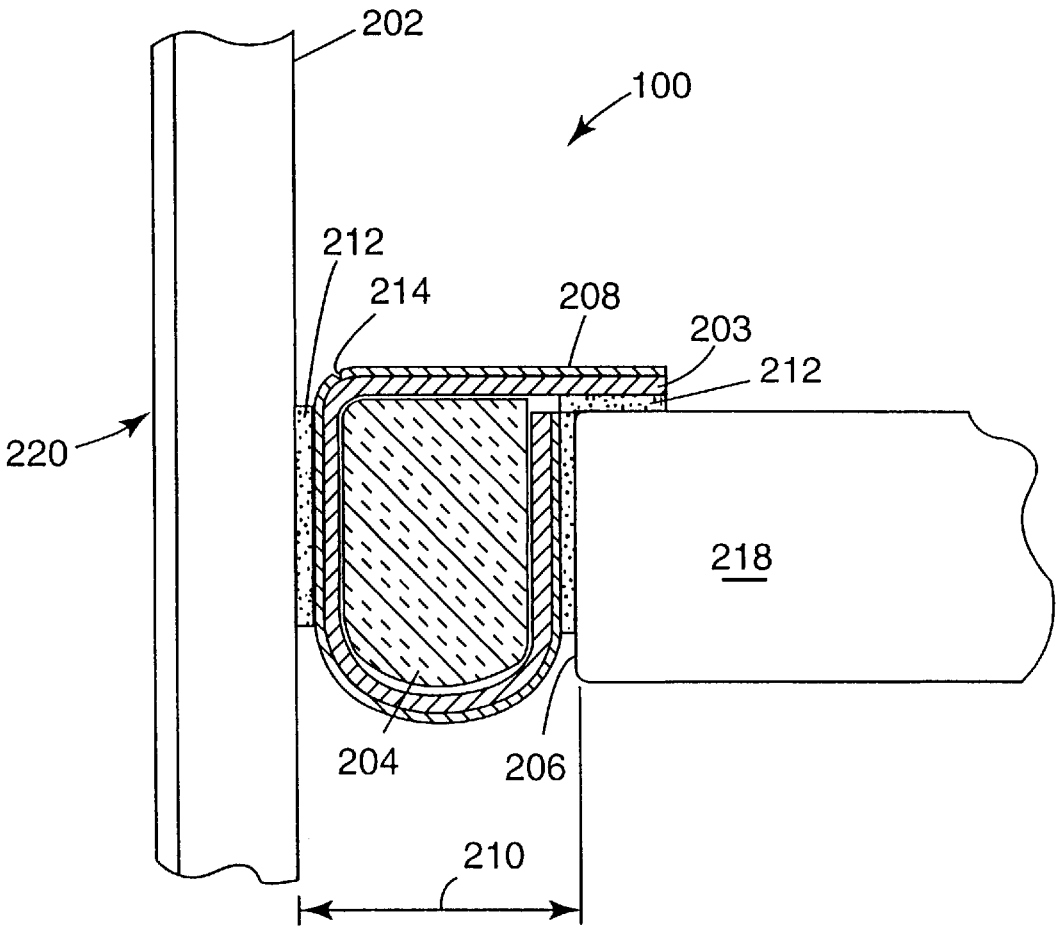

Example 3 illustrates the performance of a fire barrier device in a simulated curtain wall (see FIG. 11). A steel frame was assembled which simulated curtain wall 220 according to UL Design No. U900Z005, as set forth in the 1992 Fire Resistance Directory, Volume I, page 1043 the disclosure of which is incorporated herein by reference. The fire barrier device was evaluated using a floor furnace as described in Example 1, with similar concrete slabs forming a joint.

The simulated steel frame curtain wall was insulated between the mullions by filling the frame in with aluminum-foil-faced mineral wool (122 kg/$m^3$ (8 lbs/$ft^3$); commercially available under the trade designation "TUSG CW90 #8 MW", from United States Gypsum of Chicago, Ill.). The bottom of the frame was wrapped with 10.2 cm thick aluminosilicate ceramic fiber blanket ("FIBERFRAX") to prevent excess heat from moving through the wall from bottom and back. This was further insulated by laying more mineral wool insulation ("USG #8 CURTAIN WALL INSULATION") over the back of the mullions.

To form joint 210, a steel frame (not shown) was mounted to one of the slab edges between the edges of two 11.4 cm (4.5 inch) thick concrete slabs 198 cm long by 73.7 cm wide). The frame and slabs were mounted on the furnace such that a 20.3 cm (8 inches) wide joint 210 was formed, as measured between the steel frame and the edge of one slab. The steel frame was clamped to the edge of one of the slabs to hold it in place during the fire test.

A 198 cm (78 inch) long and 76.2 cm (30 inch) wide steel foil faced mat (commercially available under the trade designation "FIRE BARRIER I-10C MAT" from the 3M Company) 203 was cut in half across its width and then spliced back together as described in Example 1, using a 10.2 cm (4 inch) wide 0.051 mm (2 mil) steel foil strip and silicone adhesive ("FIRE BARRIER BOND AND SEAL SILICONE"). The splice was allowed to cure overnight.

Silicone adhesive material ("3M FIRE BARRIER SEAL AND BOND SILICONE") was applied with a spatula to the end face 206 of the concrete slab 218 at a thickness of 0.016 cm and to a 10.2 cm (4 inch) strip parallel to the concrete edge, on the foil face of the insulation. The silicone adhesive material was allowed to cure for 15–20 minutes until sufficiently tacky to hold the weight of the mat.

The spliced mat 203 was placed to fit along the length of joint 210 and the first 114 cm (4.5 inches) of width was pressed steel foil face 208 to silicone adhesive 212 on end face 206 of concrete slab 218 starting at the top edge. The next 25.4 cm (10 inches) of mat 203 was draped across the 20.3 cm (8 inch) joint 210 to the 10.2 cm (4 inch) strip of silicone adhesive ("FIRE BARRIER BOND AND SEAL SILICONE") 212 the insulation facing 202. The next 11.4 cm (4.5 inches) of mat 203 was pressed firmly to silicone adhesive 212 on insulation facing 202. The rest of mat 203 was held above joint 210 while a precut 198 cm (78 inch) long, 22.9 cm (9 inch) wide, and 10.2 cm (4 inch) thick piece of 61 kg/$M^3$ (4 lbs/$ft^3$) mineral wool (commercially available under the trade designation "USG 4# FIRE SAFING" from United States Gypsum of Chicago, Ill.) 204 was pressure fit into the pocket made by mat 203. The next 25.4 cm (10 inches) of mat 203 was draped across the top of joint 210 and the last 2.5 cm (1 inch) adhered to the top edge of the concrete slab 218 with a 2.5 cm (1 inch) wide strip of silicone adhesive ("FIRE BARRIER BOND AND SEAL SILICONE") 212 applied at a thickness of 0.08 (1/32 inch) to 0.16 cm (1/16 inch).

The extra 5.1 cm (2 inches) of mat 203 was to allow for the movement previously observed under these test conditions on the furnace used here.

Steel foil 208 was slit with a razor blade without slitting the intumescent layer of the mat along the top edge of the fire barrier adjacent to the foil face of the wall insulation, providing slit 214 to interrupt heat flow to the upper surface of the fire barrier.

The silicone adhesive was allowed to cure for 24 hours before testing. Gaps between the fire barrier and the furnace edge were plugged with wads of a high temperature ceramic fiber ("FIBERFRAX").

The resulting fire barrier system was subjected to a 3 hour fire test according to ASTM E119-88. Sufficient silicone adhesive remained intact to hold the barrier in place for 3 hours. The surface of the adhesive material exposed to the fire test at the mat 208/slab 206 interface disintegrated 7.6 cm (3.0 inches) up from the fire side. Similar effects were observed on the insulation side where the aluminum facing 202 had also burned away where the adhesive was gone. This test received a 1 hour rating an d almost made a 2 hour rating. The average cold side ambient temperature before the test was 20° C. (68° F.).

Example 4

Figure 12:
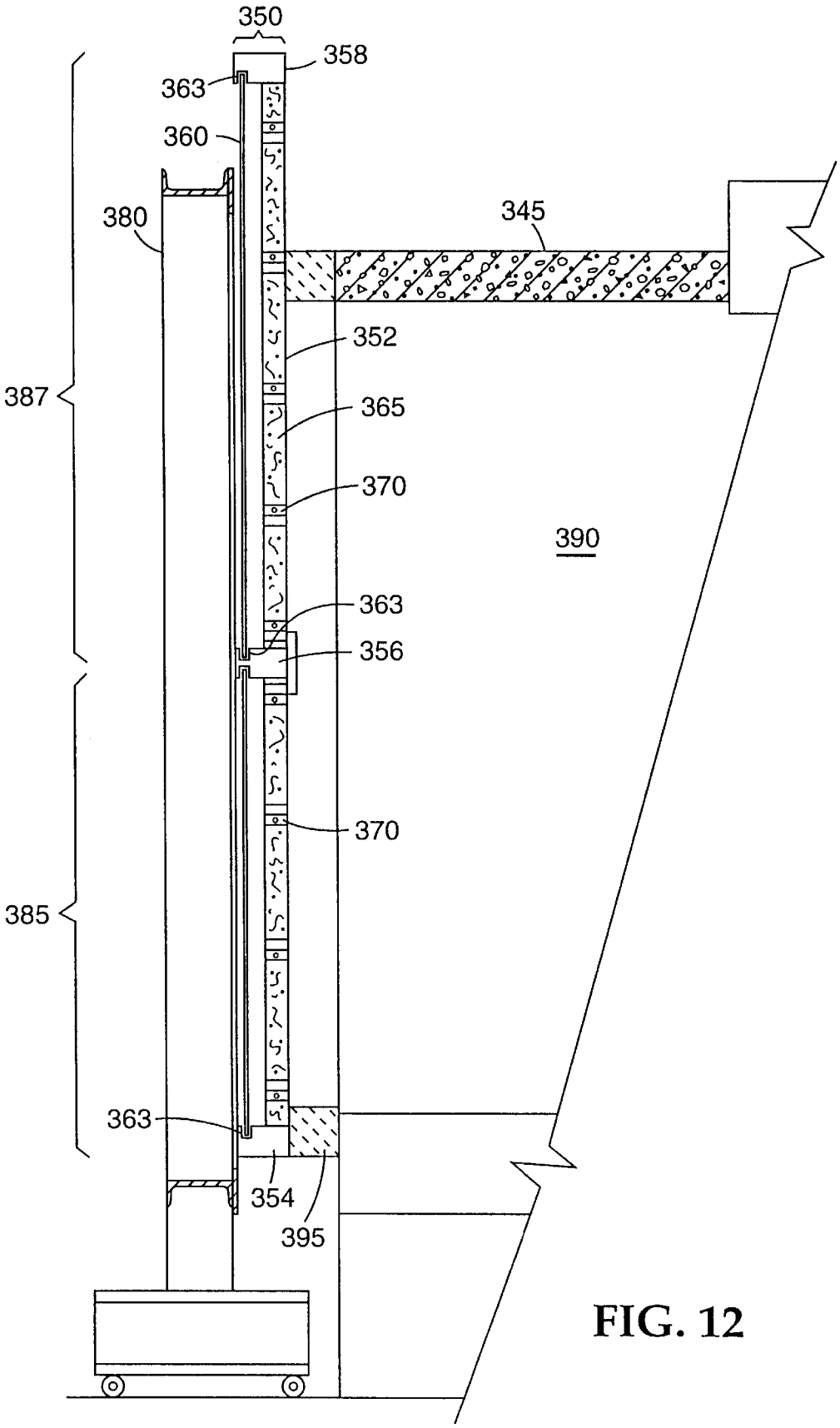
FIG. 12 is a sectional view of the curtain wall/floor slab/wall furnace used in Example 5.

Example 4 illustrates the performance of a fire barrier device in a simulated curtain wall. A construction joint was assembled which simulated a 20.4 cm (8 inch) joint between an aluminum frame curtain wall and a 2 hour rated 11.4 cm (4.5 inch) thick concrete floor slab. Referring to FIG. 12, curtain wall 350 was comprised of two vertical 352 and three horizontal 354, 356, and 358 aluminum mullions, 5.1 cm (2 inches) deep with 0.64 cm (¼ inch) thick untempered glass glazing 360 on the exterior face. The glass was held to the mullions by a conventional framing slot 363 extruded as part of the mullion. Vertical mullions 352 were 152 cm (60 inches) apart on center. Horizontal mullions 354, 356, and 358 were placed so the top surface of horizontal mullion 358 was 45.7 cm (18 inches) above the top of floor slab 345, and top of middle horizontal mullion 356 was 91.5 cm (36 inches) below the top of floor slab 345.

Bottom horizontal mullion 354 was another 91.5 cm (36 inches) on center below middle horizontal mullion 356. Steel insulation pins 370 were attached 30.5 cm (12 inches) on center and 15.2 cm (6 inches) from ends of both vertical 352 and horizontal 354, 356, and 358 mullions and 5.1 cm (2 inch) thick 122 kg/M$^3$ (8 lbs/ft$^3$) aluminum foil faced mineral wool ("USG CW90 8# MW") 365 was fit tightly between the mullions with the foil face towards the interior of the furnace. Splices were taped with aluminum foil tape on the foil facing. The mullions surrounding upper wall section 387 including middle horizontal mullion 356 were covered with 10.2 cm (4 inch) wide, 2.5 cm (1 inch) thick 122 kg/M$^3$ (8 lbs/ft$^3$) aluminum foil faced mineral wool ("USG CW90 8# MW"). The foil facing of the mineral wool was taped to the wall insulation foil facing with aluminum foil tape. Lower wall section 385, which would normally be considered a vision area, was blocked off and the portion of the mullions surrounding this section, excluding middle horizontal mullion 356, were completely covered by another layer of 5.1 cm (2 inch) thick 122 kg/M$^3$ (8 lbs/ft$^3$) mineral wool ("USG CW90 8# MW"). Whole wall 350 was positioned in frame 380, which was wheeled up to and clamped to the front of the furnace 390, giving a 20.3 cm (8 inch) spacing between vertical mullions 352 and slab 345.

A 2 hour rated 11.4 cm (4.5 inch) thick concrete floor slab 345, 71.1 cm (28 inches) deep by 213.4 cm (84 inches) wide, had been positioned on top of furnace 390 such that there was a 20.3 cm (8 inch) joint space at the front of furnace 390 between floor slab 345 and vertical curtain wall mullions 352. Wall 350 and frame 380 were clamped in place and a fire barrier as described in Example 3 was installed in the 20.4 cm (8 inch) joint space. The assembly was allowed to cure for 48 hours before testing. Gaps between the fire barrier/wall assembly and the furnace were plugged with wads of high temperature ceramic fiber ("FIBERFRAX") 395.

A fire test was run according to ASTM E119-88. The wall/barrier/slab assembly survived 1 hour and 45 minutes. It received a one hour rating based on the temperature on the cold side of the fire barrier. Enough heat penetrated up through the wall insulation 365 to the cold side of the barrier at 1 hour and 45 minutes to cause the barrier to fail the ASTM E119-88 temperature requirements. The bond created with the adhesive material continued to hold the barrier in place at the edges of the aluminum foil on the insulation at the upper edge of the barrier even after the temperature requirements (as set forth in ASTM E119-88) were exceeded at that edge.

The average ambient temperature on the cold side of the fire barrier prior to the test was 19° C. (67° F.)

Example 5

Example 5 illustrates the performance of a fire barrier device in a simulated curtain wall. A construction joint was assembled which simulated an aluminum frame curtain wall. This curtain wall was insulated, constructed, and tested as described in Example 4 except that that a steel foil-faced intumescent mat ("FIRE BARRIER I-10C MAT") was used instead of the additional insulation over the mullions. The foil face of the mat was bonded with silicone adhesive material ("3M FIRE BARRIER SEAL AND BOND SILICONE") at a thickness of 0.08 cm (1/32 inch) to 0.16 cm (1/16 inch) over the surface of the mullions.

The mat ("FIRE BARRIER I-10C MAT") covered the interior surface of the wall above and including the middle horizontal mullion to a line 5.2 cm (2 inches) above the bottom of the floor slab (i.e., the center of the joint area). This mat was put on the wall in a single 91.5 cm (36 inch) high by 162.6 cm (64 inch) wide piece, slightly extending beyond the vertical mullions, before the wall was clamped to the furnace. The extending edges of the mat were folded into the furnace such that the mat was not artificially held up between the furnace and the mullions or frame. A fire barrier as described in Example 4 was installed between the wall and the slab. Silicone adhesive ("FIRE BARRIER BOND AND SEAL SILICONE") was applied at a thickness of 0.08 cm (1/32 inch) to 0.16 cm (1/16 inch) to the top 5.1 cm (2 inches) of the non-foil side (face) of the wall mat that extended approximately 5.1 cm (2 inches) into the joint area, and the foil face of the fire barrier was adhered to this top 5.1 cm (2 inches) of the wall mat as well as approximately 5.1 cm (2 inches) of insulation ("USG CW90 8# MW") facing above it.

The assembly was allowed to cure for 48 hours before testing. Gaps between the fire barrier/wall assembly and the furnace were plugged with wads of high temperature ceramic fiber ("FIBERFRAX").

The fire test rating was 2 hours, based on the temperature on the cold side. Failure according to the ASTM E119-88 test due to an increase in temperature on the cold side occurred at 2 hours, 5 minutes. The barrier was still intact at this time, with no penetration of smoke or flame. The average ambient temperature on the cold side of the fire barrier prior to the test was 20.6° C. (69° F.). The fire barrier was rated at 2 hours.

Illustrative Example

This example illustrates the performance of a silicone adhesive material ("3M FIRE BARRIER SEAL AND BOND SILICONE") in a fire condition. A 0.19 m$^3$ (7 ft$^3$) gas fired furnace (commercially available as a kiln from Olympic Kilns of Atlanta, Ga.) was used to produce the temperature/time curve described in ASTM E119-88 (the temperature of the furnace was monitored with thermocouples ("K" type thermocouples with 6.35 mm (0.25 inches) diameter steel sheaths) mounted at various locations on the inside top of the furnace). The furnace had a circular 81.3 cm (32 inches) diameter opening 166 at the top over which were positioned samples for the fire test.

Figure 9:
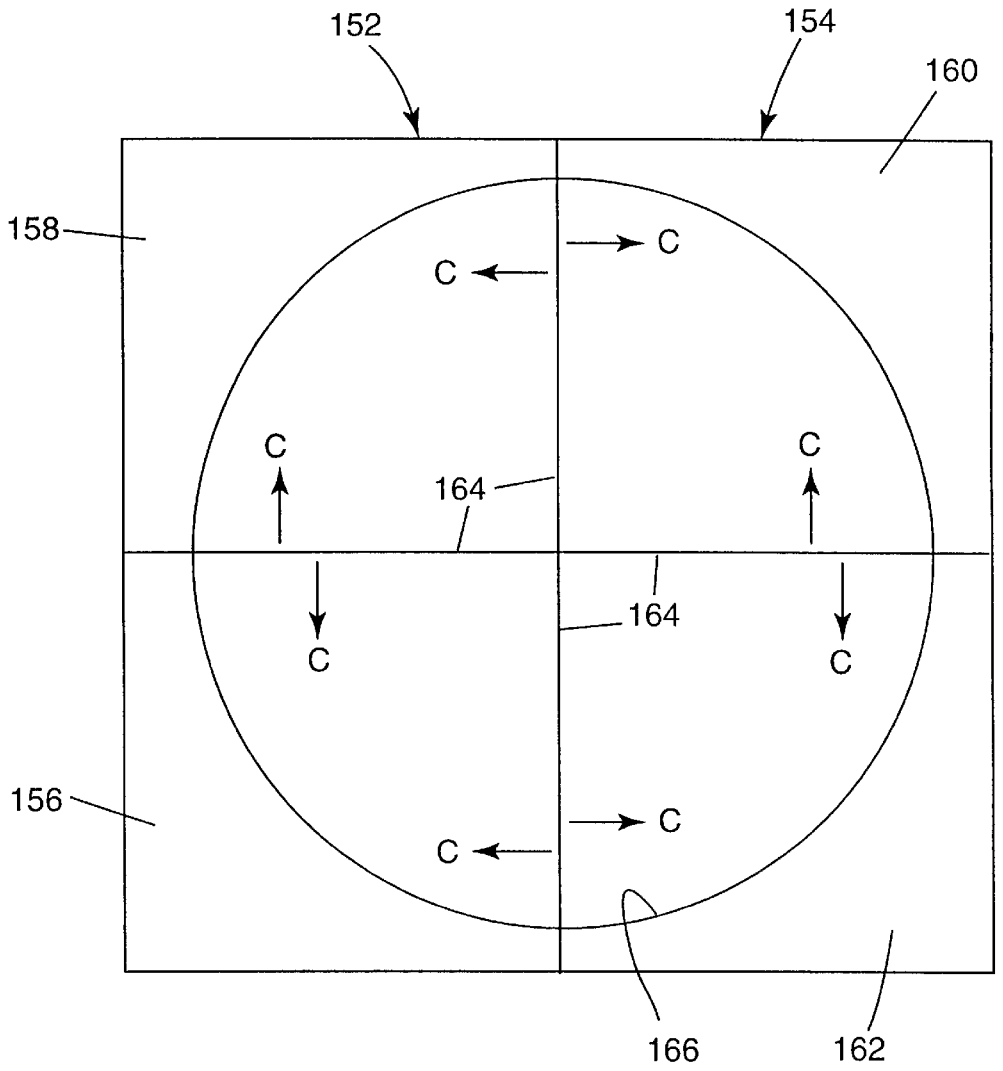
FIG. 9 is a top view of an exemplary testing configuration of a fire barrier as viewed from inside a test chamber.

The preparation of the samples for testing is illustrated in FIG. 9. Silicone adhesive material ("3M FIRE BARRIER SEAL AND BOND SILICONE") was troweled onto a 0.63 cm thick steel plate 152 and onto a 11.4 cm (4.5 inches) thick cement slab 154 at a thickness of about 0.16 cm (1/16 inch). The adhesive material was allowed to cure for about 15 minutes. Four rectangular sections 156, 158, 160, 162 were cut from intumescent sheet material ("FIRE BARRIER I-10C") laminated to steel foil. The foil side of section 156 and the intumescent side of section 158 were placed onto the adhesive on the steel plate 152. The foil side of section 162 and the intumescent side of section 160 were positioned similarly on the cement slab 154. The samples were allowed to cure for 24 hours, then these samples were placed on top of the opening 166 of the furnace with the intumescent sheet material facing the fire from the furnace. The portion of the samples inside the opening 166 of the furnace were exposed to the test.

The furnace was run for 2 hours according to the time-temperature curve of FIG. 1 as published in ASTM E119-88. The average furnace temperature was 986° C. (1807° F.). The temperature of the adhesive was monitored by means of unsheathed thermocouples placed between the intumescent mat and the plate or slab. Thermocouples were also placed on the cold side (i.e., the top) of the assembly. The temperatures were measured on the adhesive and on the cold side after two hours of heating and are listed in the Table below:

| Configuration | Adhesive Temp., ° C. | Cold side. Temp., ° C. |
|---|---|---|
| foil face/slab | 399 | 204 |
| foil face/steel plate | 414 | 300 |
| non-foil side/slab | 368 | 201 |
| non-foil side/steel plate | 397 | 394 |

After the furnace had cooled, the samples were removed from the top of the furnace and examined for adhesive failure. The silicone adhesive had oxidized about 5.1 cm (2 inches) in from exposed edges 164 in the direction indicated by arrows "C" in FIG. 9. However, the remainder of the adhesive was intact and the intumescent mat was firmly attached to the concrete and to the steel sheet.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A fire barrier system for a joint formed between a first structural element having a first attachment area and a second structural element having a second attachment area, the first and second structural elements defining a space having a width and a length, the width varying from a minimum width to a maximum width as the first and second structural elements move with respect to one another, the fire barrier system comprising:

a flexible sheet of a fire barrier material comprising a first portion attachable to the first attachment area by a first attachment means, a second portion attachable to the second attachment area by a second attachment means, and an intermediate portion having an intermediate mass located generally in the space, at least one of the attachment means comprising an adhesive material of a type that provides an adhesive material bond having at least one of a tensile or shear bond strength which in force units is at least equal to ¼ of the product of the mass of the intermediate portion of the flexible sheet times 1.0 g, whereby the adhesive material provides a barrier to smoke passing between the flexible sheet and the first structural element.

2. The fire barrier system of claim 1 wherein the adhesive material bond has a tensile bond strength which in force units is at least equal to ¼ of the product of the mass of the intermediate portion times 1.0 g.

3. The fire barrier system of claim 1 wherein the adhesive material bond has a shear bond strength which in force units is at least equal to ¼ of the product of the mass of the intermediate portion times 1.0 g.

4. The fire barrier system of claim 1 wherein the adhesive material bond has at least one of a tensile or a shear bond strength which in force units is at least equal to ½ of the product of the mass of the intermediate portion times 1.0 g.

5. The fire barrier system of claim 1 wherein the adhesive material bond has at least one of a tensile or a shear bond strength which in force units is at least equal to the product of the mass of the intermediate portion times 1.0 g.

6. The fire barrier system of claim 1 wherein the adhesive material provides a barrier to smoke passing between the flexible sheet and the second structural element.

7. The fire barrier system of claim 1 wherein the flexible sheet extends along at least one of the first attachment area or the second attachment area to substantially conceal the adhesive material between the flexible sheet and the at least one attachment area.

8. The fire barrier system of claim 1 wherein the flexible sheet comprises a plurality of flexible sheets joined together defining gaps therebetween.

9. The fire barrier system of claim 1 wherein the flexible sheet of fire barrier material comprises a multi-layer composite structure.

10. The fire barrier system of claim 1 wherein the adhesive material is selected from a group consisting of silicone adhesive material, epoxy adhesive material, acrylic adhesive material, urethane adhesive material, and combinations thereof.

11. The fire barrier system of claim 1 wherein the flexible sheet is selected from a group consisting of a glass fiber mat, a mineral fiber mat, a ceramic fiber mat, a ceramic fiber fabric, an intumescent sheet material, and an endothermic sheet material.

12. The fire barrier system of claim 1 wherein the first portion of the flexible sheet comprises a generally downward facing surface.

13. The fire barrier system of claim 1 wherein the first portion of the flexible sheet comprises a generally upwardly facing surface.

14. The fire barrier system of claim 1 wherein the adhesive material comprises a char-forming adhesive material.

15. The fire barrier system of claim 1 wherein the adhesive material is a silicone adhesive material.

16. The fire barrier system of claim 1 wherein at least one surface of the flexible sheet includes a layer of metal foil.

17. The fire barrier system of claim 1 wherein the foil layer is engaged with the adhesive material.

18. The fire barrier system of claim 1 wherein the attachment means includes a mechanical attachment mechanism.

19. The fire barrier system of claim 1 wherein both the first attachment means and second attachment means comprise the adhesive material.

20. The fire barrier system of claim 1 wherein at least one of the first or second attachment means consists essentially of the adhesive material.

21. The fire barrier system of claim 1 wherein the first and second attachment areas are juxtaposed to define the space.

22. A fire barrier system for a dynamic joint in a structure capable of withstanding a fire test condition, the dynamic joint including a first structural element having a first attachment area and a second structural element having a second attachment area, the first and second structural elements being moveable with respect to one another, the first and second attachment areas defining a space therebetween, the space having a fixed length and a width which varies from a minimum width to a maximum width as the elements move with respect to each other, fire barrier system comprising:

a flexible sheet of a fire barrier material comprising a first portion attached to the first attachment area by a first attachment means, a second portion attached to the second attachment area by a second attachment means, and an intermediate portion having an intermediate mass located generally in the space, at least one of the attachment means comprising an adhesive material of a type that provides an adhesive material bond having at least one of a tensile or a shear bond strength which in force units is at least equal to ¼ of the product of the mass of the intermediate portion of the flexible sheet times 1.0 g, the fire barrier system being capable of withstanding a fire test condition, whereby the adhesive material provides a barrier to smoke passing between the flexible sheet and the first structural element.

23. The fire barrier system of claim 22 wherein the adhesive material bond has at least one of a tensile or a shear bond strength which in force units is at least equal to ½ of the product of the mass of the intermediate portion times 1.0 g.

24. The fire barrier system of claim 22 wherein the flexible sheet extends along at least one of the first attachment area or the second attachment area to substantially conceal the adhesive material between the flexible fire barrier material and the at least one attachment area.

25. The fire barrier system of claim 22 wherein the attachment means includes a mechanical attachment mechanism.

26. The fire barrier system of claim 22 wherein both the first attachment means and second attachment means include the adhesive material.

27. The fire barrier system of claim 22 wherein the first and second attachment means consists essentially of the adhesive material.

28. A method for attaching a fire barrier device to a dynamic joint in a structure, the dynamic joint including a first structural element having a first attachment area and a second structural element having a second attachment area, the first and second structural elements being moveable with respect to one another, the first and second attachment areas defining a space therebetween, the space having a fixed length and a width which varies from a minimum width to a maximum width as the elements move with respect to each other, the method for attaching comprising the step of:

attaching a first portion of a flexible sheet of a fire barrier material to the first attachment area by a first attachment means and attaching a second portion of the flexible sheet to the second attachment area by a second attachment means, the flexible sheet having an intermediate portion with an intermediate mass located generally in the space, at least one of the attachment means comprising an adhesive material of a type that provides an adhesive material bond having at least one of a tensile or a shear bond strength which in force units is at least equal to ¼ of the product of the mass of the intermediate portion of the flexible sheet times 1.0 g, whereby the adhesive material provides a barrier to smoke passing between the flexible sheet and the first structural element.

29. The method of claim 28 wherein the adhesive material bond has at least one of a tensile or a shear bond strength which in force units is at least equal to ½ of the product of the mass of the intermediate portion times 1.0 g.

30. The method of claim 28 wherein the adhesive material bond has at least one of a tensile or a shear bond strength which in force units is at least equal to the product of the mass of the intermediate portion times 1.0 g.

31. The method of claim 28 wherein the fire barrier system is capable of withstanding a fire test condition.

32. The method of claim 28 wherein at least one of the first or second attachment means consists essentially of the adhesive material.

* * * * *